United States Patent [19]

Nandra et al.

[11] Patent Number: 4,744,999

[45] Date of Patent: May 17, 1988

[54] HIGH THROUGHPUT, HIGH UNIFORMITY FIELD EMISSION DEVICES

[75] Inventors: Shangar S. Nandra, Chessington; Frank G. Wilson, Merrow, both of United Kingdom

[73] Assignee: Engelhard Corporation, Menlo Park, N.J.

[21] Appl. No.: 524,942

[22] Filed: Aug. 22, 1983

[30] Foreign Application Priority Data

Sep. 9, 1982 [GB] United Kingdom ..... 8225767
Sep. 9, 1982 [GB] United Kingdom ..... 8225768

[51] Int. Cl.[4] ..... B05D 1/04
[52] U.S. Cl. ..... 427/13; 118/621
[58] Field of Search ..... 427/13, 27, 422, 49, 427/50; 118/621, 624, 627; 239/3, 696, 698

[56] References Cited

U.S. PATENT DOCUMENTS 2,719,820 10/1955 Allen ..... 427/427
4,095,962 6/1978 Richards ..... 239/3
4,264,641 4/1981 Mahoney et al. ..... 427/27
4,374,162 2/1983 Takagi ..... 427/422

FOREIGN PATENT DOCUMENTS 2057300 4/1981 United Kingdom .

OTHER PUBLICATIONS

Clampitt *Thin Solid Films* vol. 64 No. 3 (12-1979) pp. 471-478.
Pang et al. *Thin Solid Films* vol. 88 No. 3 (2-1982) pp. 219-224.
Prewitt et al. *Thin Solid Films* vol 80 Nos. 1-3 pp. 117-124 Jun. 1981.

*Primary Examiner*—John H. Newsome

[57] ABSTRACT

Field emission spraying of liquified metals is obtained using an electrically heated face plate in contact with the metal to be sprayed with nozzles formed in the face plate. The face plate is wettable by, but insoluble in, the metal to be sprayed and is maintained at a temperature in excess of the melting point of the metal to be sprayed by passing an electric current therethrough.

21 Claims, 3 Drawing Sheets

HIGH THROUGHPUT, HIGH UNIFORMITY FIELD EMISSION DEVICES

Field emission techniques are potentially highly effective for forming sprays of charged atoms and droplets from liquid metal sources for use in a wide variety of operations. These sprays may be used in ion beam processes, for coating substrates or for forming very fine metal powders. This invention is concerned with an improved device for providing high uniformity sprays at high throughput. Formation of charged atoms and droplets from a liquid source in an electric field has long been known for both conducting and non-conducting liquids and has been extensively used for example in paint spraying. When such a process is used in vacuo with a liquid metal as feed, charged atoms are emitted when the field strength becomes sufficiently high and, as it is further increased, charged droplets of metal are also emitted. The resulting spray of charged droplets and/or charged atoms can be used for producing metals in droplet or powder form, and for coating substrates, the process being often referred to as field emission spraying; when applied to the coating of substrates, it is usually termed field emission deposition. When the spray contains charged atoms only, it can also be used for ion implantation, ion beam milling, secondary ion mass spectroscopy and ion beam lithography.

The problems arising in designing processes of this kind for industrial operation are mainly concerned with the fabrication and operation of the charged spray source and the provision of a sufficiently high throughput. Charged spray sources at present employed are usually wetted needle electrodes or hollow electrodes in the form of a tapered nozzle containing molten metal and positioned close to and opposite an apertured extractor electrode at a different potential (bias voltage) usually of about 1–18 kV (more usually 5–18 kV) from that of the needle or nozzle electrode.

For industrial applications, it is usually desirable to achieve a highly uniform spray at high throughput. The throughput of material will initially increase as the potential difference between the needle or nozzle electrode and the extractor electrode is increased. However when a spray containing charged atoms only is desired, the potential difference is limited to that at which droplets start to appear. Furthermore, for a spray containing both atoms and droplets, there is a limit to the potential difference which can be usefully applied: above this limit the spray becomes unstable through flooding of the needle or nozzle, with resultant arcing between the two electrodes; also in the case of spraying onto a substrate to form a coating deposit, it is found that the quality of the coating deteriorates, ion currents in excess of 500 micro-amperes per nozzle being typically associated with powdery and unsatisfactory deposits.

Therefore, in order to obtain high throughput, the use of an array of charged spray sources is indicated. For example, hundreds of sources may be required to achieve commercially realistic throughput rates. Although the use of multiple needle sources has been claimed, for example in UK Pat. No. 1 574 611, no satisfactory multiple nozzle source has yet been devised because of the above mentioned problems of fabrication and operation. Present commercially available sources consist of a machined cylindrical nozzle heated by radiation from a surrounding cylindrical heating coil. It is found that individual sources exhibit slightly different operating characteristics resulting from unavoidable differences in the geometry and dimensions of the nozzle and the associated components. Hence, if a number of individual sources are assembled into an array with a common power supply, uniform operation and performance of each source will not be achieved. Furthermore, because of the physical size of a source comprising a cylindrical nozzle and surrounding heating coil, difficulties may be encountered in packing the nozzles together with sufficient density.

For continuous operation of a source, it is necessary to be able to replenish the material being sprayed, for example by insertion of a wire into each hollow electrode. Consequently the feeding of a large array of individual sources may also present severe operational difficulties.

We have now found that multi-nozzle charged spray source arrays of satisfactorily high throughput and uniformity of operation can be formed of a strip or sheet of electrically conductive material, resistively heated by passage of electrical current therethrough, the material being wettable by, but insoluble in, the metal to be sprayed, provided with two or more substantially uniform conical depressions each having a uniform orifice. Such arrays can for example be made from strip or sheet by using a punch and die technique, as hereinafter exemplified, or by electroforming upon a suitably shaped former. These arrays have been found to exhibit substantially uniform spray characteristics showing that in such arrays, individual nozzles can be produced by the techniques described to a sufficient degree of uniformity. In operation, the strip or sheet of electrically conductive material carries a current and operates as a self-heating unit for the nozzles, thus eliminating the need for individual nozzle heaters; temperature edge effects are compensated by appropriately designing the geometry of the strip or sheet. The self-heating strip or sheet can be formed to provide a single common reservoir for the material to be sprayed, thus eliminating the difficulty of individually feeding each nozzle.

The extractor electrode array is situated close to and opposite the nozzle array so that the spray from each nozzle passes through a corresponding aperture in the extractor electrode. The tip of the nozzle is usually situated outside the neighboring surface of the extractor electrode, but it may also be situated within the aperture so that the tip is within the neighboring surface of the extractor electrode. In some cases, the substrate to be coated can itself serve as the extractor electrode.

Preferred operating conditions for field emission spraying using the charged spray source arrays of this invention are: voltage between nozzle and extractor electrode between 1 and 18 kV (more usually between 5 and 18 kV); nozzle orifice diameter between 5 and 500 micro-meters; more preferably between 5 and 250 micro-meters, nozzle height between 1 and 5 mm; separation between nozzle tips and neighboring surface of extractor electrode between 0 and 2 mm. In some circumstances, orifice diameters as small as 2 micro-meters can be used.

A major difficulty encountered in the use of any feed electrode array for the deposition of metal droplets upon a substrate arises from the fact that the charged spray emitted from the feed source contains not only charged droplets of metal, these forming the deposit, but also charged atoms. The latter often have a useful function in that they compact the deposit and also have a cleaning effect on the substrate and therefore promote good adhesion; but when multiple arrays of feed sources are used, as is necessary to obtain reasonably high throughput and therefore high deposition rates, a serious loss of deposit is found to occur probably due to sputtering by charged atoms, since the spray of charged atoms from each feed source apparently forms a wider cone than the spray of charged droplets and can therefore interfere with a deposit from a neighboring feed source. A similar loss of deposit is observed from an isolated feed source (in which there is no interference from a neighboring feed source) when there is relative movement between source and substrate during deposition. We have found that the preferred extractor electrodes of the present invention serve as a means to intercept, limit and/or absorb the spray of charged atoms, thus reducing deposit losses caused by sputtering.

The invention accordingly relates to a high-throughput feed electrode nozzle array of electrically charged spray sources for field emission spraying (as hereinbefore defined) of metals or alloys in the liquid state comprising a strip or sheet of electrically conductive material insoluble in but wettable by the metal to be sprayed, having formed within it an array of two or more substantially conical nozzles each having a uniform orifice, said strip or sheet being capable of resistive heating by passage of an electric current therethrough to a temperature in excess of the melting point of the metal to be sprayed; to the use of the ion sprays produced from said nozzle array in the production of metal droplets, powders and coatings; and to metal droplets, powders and coatings when so produced, as well as the use of ion sprays so produced in ion implantation, ion beam milling, secondary ion mass spectroscopy and ion beam lithography.

Preferred field emission devices of the present invention further comprise an array of charged spray sources and an extractor electrode array for field emission deposition. The preferred extractor electrode array for droplet spray formation comprises means for intercepting charged atoms defining two or more sets of apertures bounded by electrically conductive material and lying within two or more parallel planes substantially perpendicular to the direction of feed metal spray, each said set of apertures corresponding to an individually charged spray source and being so arranged that the central axis of said charged spray source passes through all the apertures in said set; the apertures within the plane of the extractor electrode array nearest to the feed electrode array being substantially circular and of uniform area. The preferred processes of the present invention also relate to the field emission deposition processes using the above-described extractor electrode array.

DESCRIPTION OF THE PREFERRED EMBODIMENTS

Figure 1:
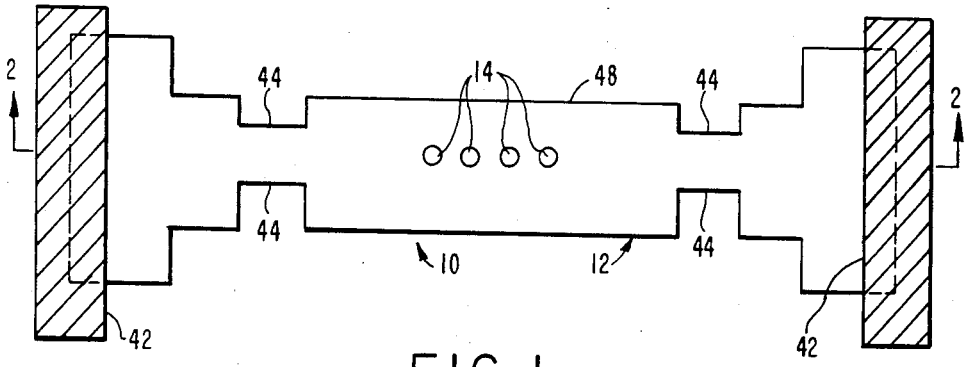
FIG. 1 is a schematic plan view of an electrically heated face plate used in the present invention.
Figure 2:
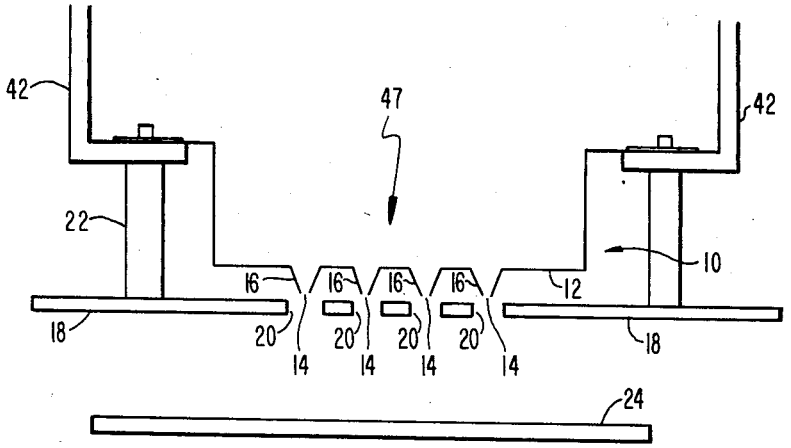
FIG. 2 is a schematic sectional view of a spray device of the present invention.

FIGS. 1 and 2 illustrate preferred embodiments of the present invention wherein feed chamber 10 is provided with molybdenum face plate 12 having orifices 14 formed therein at the points of conical protrusions 16. Copper extractor electrode 18 having apertures 20 formed therein is supported by alumina insulating supports 22 such that apertures 20 are substantially coaxial with orifices 14. In operation, feed metal is placed in contact with face plate 12 as an electric current is passed through face plate 12 thus heating face plate 12 and melting feed metal inside protrusions 16. As the positive voltage on extractor electrode 18 is increased to a sufficient value, metal sprays through orifices 14 and apertures 20 onto substrate 24.

The configuration shown in FIGS. 1 and 2 is capable of providing sprays of charged atoms, droplets or both depending on the potential difference between face plate 12 and extractor electrode 18.

Figure 3:
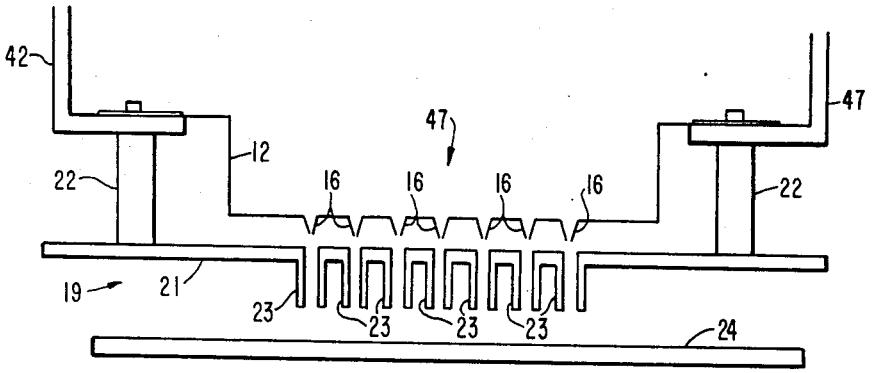
FIG. 3 is a schematic sectional view of an alternative spray device of the present invention.

FIG. 3 illustrates a preferred extractor electrode array of this invention which achieves efficient removal of the charged atoms in the spray whilst allowing a large flux of charged droplets to pass through to the substrate, while also providing sufficient field enhancement at the tips of the spray sources to produce efficient spraying without electrical arcing occurring between the extractor electrode array and any of the spray sources. In FIG. 3, an array of protrusions 16 with apertures 14 is formed in face plate 12 as in FIGS. 1 and 2. Preferred extractor electrode 19 comprises extractor plate 21 having a plurality of cylindrical electrodes 23 mounted thereon each being opposite one of conical protrusions 16 and having a cylindrical axis collinear with the axis of its associated conical protrusion 16. For each particular field emission deposition process, there is an optimum position of the spray sources relative to the apertures in that plane of the extractor electrode array nearest the feed electrode array to most efficiently intercept charged atoms while allowing charged droplets to pass through the aperture. Generally the tips of the spray sources will be close to this plane, but they may lie a little outside the extractor electrode array or they may lie a little within the extractor electrode array. Increasing the distance of the spray source tips away from the extractor electrode array will decrease the proportion of charged atoms subsequently passing through the nearest plane of the extractor electrode array. However, it will also increase the losses of metal droplets, leading to a reduction in overall coating rate and an undesirable build-up of droplets on the extractor electrode array itself. Conversely, increasing the depth of penetration of the spray source tips within the extractor electrode apertures will impose a lower limitation on the thickness (measured by the distance between the two outer planes of the electrode), of the extractor electrode array for formation of a spray consisting substantially of droplets since if this thickness is too low, the intercepting effect conferred by the invention will be largely lost. Even when the spray source tips do not lie within the extractor electrode apertures, we have found that for optimum droplet spray formation, the thickness of the extractor electrode should not be substantially less than the radius of the neighboring apertures.

Figure 4:
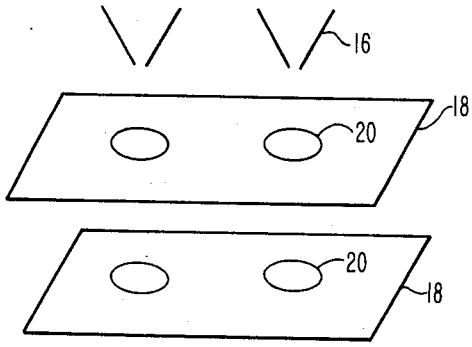
FIGS. 4 and 5 are schematic sectional views illustrating the relationship between the nozzles and alternative extractor electrodes useful in the present invention.
Figure 5:
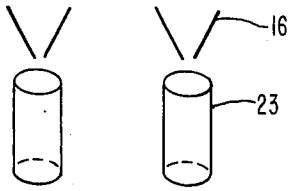
Figure 6:
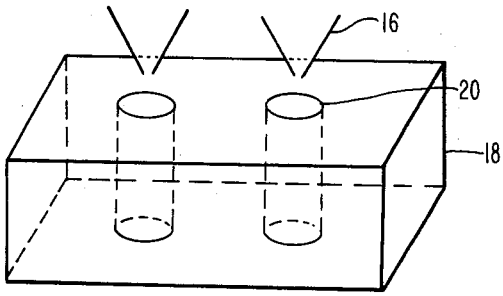
FIG. 6 illustrates another possible extractor electrode configuration.

A preferred droplet spray extractor electrode array comprises, for example, two parallel sheets of electrically conductive material on opposite faces of a non-conductive support, corresponding circular apertures of equal cross-section being formed in each sheet as well as the non-conductive support, each aperture corresponding to, and coaxial with, a charged spray source 16 (FIG. 4); In another preferred embodiment, the apertures in the extractor electrode are surrounded by hollow cylinders of electrically conductive material (FIG. 5, in which material supporting the cylinders is not shown); In still another preferred embodiment, the apertures are cylindrical passages through a sheet of electrically conductive material (FIG. 6). Where uniform coating of the substrate is desired, the individual feed sources should usually be as close together as possible, thus requiring correspondingly close spacing of the apertures in the extractor electrode array, and an embodiment employing cylindrical apertures through a conductive material is to be preferred; on the other hand, for the deposition of discrete spots or geometrical shapes upon the substrate, a suitable embodiment of the invention consists of two or more sheets containing apertures which, at least in the sheet furthest from the feed electrode array, are such as to define the shape of the deposit required.

By the above means any desired pattern of deposit can be attained by suitable selection of the position of the food sources and the corresponding shape of the lower apertures within the extractor electrode. Furthermore, additional patterns, for example, stripes can be achieved by relative movement of the source and substrate during deposition. Such an embodiment is described in the examples hereinafter. The operation of the spray may be continuous or it may be switched on and off to give a series of deposits as a result of the relative movement of the source and substrate. Such relative movement may also be continuous or it may be switched on and off and so that an appropriate pattern of deposit is obtained on the substrate. It will be apparent that the operation of a field emission deposition process employing extractor electrodes according to this invention can be readily automated by electrical control of the potential between the extractor electrode and the face plate. In certain applications, particularly those involving ion sprays particularly efficient results and even patterns can be obtained by electrical control of the potential on groups of extractor electrodes or even individual extractor electrodes for each spray aperture and the relative movement of the substrate to be coated.

In many cases, automation of the process may be simplified by monitoring the current which is generated in the substrate arising from the charge upon the deposited ions, therefor, and can be used to monitor and control the deposition rate.

In order to avoid contamination of the deposit from material sputtered from the extractor electrodes which are also the subject of this invention, the preferred extractor electrodes are suitably made either of the feed material itself or of one or more constituents of the feed material or from a material resistant to sputtering, such as molybdenum.

In addition to the use of alloys as feed, stoichiometry being substantially preserved during alloy deposition, the production of alloys in situ upon the substrate, or of layers of alloy bonding the deposit thereto, is possible according to the invention by pre-coating the substrate with one or more alloying ingredients for the deposit.

The invention is illustrated but not limited by the following examples.

EXAMPLE 1

Figure 7:
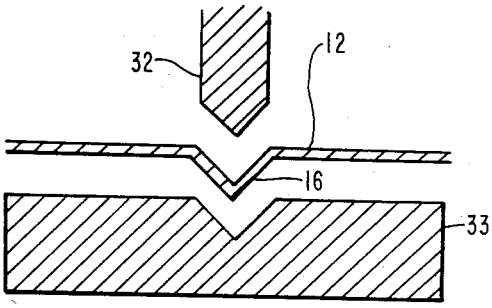
FIGS. 7 and 8 schematically illustrate methods of forming nozzles.
Figure 8:
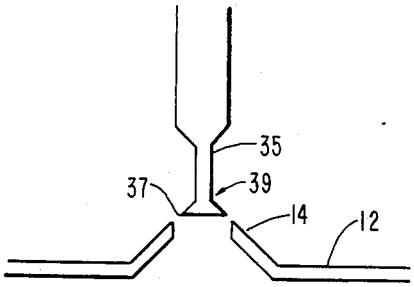

This example illustrates fabrication of a charged spray source array according to the invention when the metal to be sprayed is gold. Electrically conductive face plate 12 is suitably of molybdenum of a thickness of about 0.1–1.0 mm and is formed as illustrated in FIGS. 7 and 8, showing the formation of a single nozzle. Molybdenum strip 12 is annealed and placed between a first punch 32 having a punch angle of about 90° and die 33 having an inverse conical depression of angle about 60° and depth suitably about 2–5 mm, and punch 32 is gradually pressed into the strip until it extends to fill about 80% of the die depth. The strip is again annealed and then pressed further into the die (to about 95% of the die depth) using a second punch (not shown) having a punch angle of about 70°. After a further annealing, the protrusion 16 is pressed fully into the die using a third punch (not shown) having a punch angle of about 50°. As shown in section in FIG. 8, the tip of protrusion 16 is then punctured and broached, using conical cutting tool 35 wherein base 37 of cone 39 forms the cutting edge.

Orifices suitably lying between five and several hundred microns in diameter may easily be so produced.

EXAMPLE 2

In this example, the spraying of gold is illustrated with reference to FIGS. 1 and 2. Face plate 12 contained twenty nozzles in a row, spaced 4 mm apart in a 0.25 mm thick molybdenum strip. Copper extractor electrode 18 containing twenty apertures each of diameter 3 mm, was assembled opposite the nozzles such that the nozzle axes and the centres of the aperture holes were collinear. The assembled source was mounted in a vacuum chamber (not shown). In FIG. 1, the assembly as mounted is shown in plan from above and FIG. 2 shows a sectional view along line 2—2 (only a few of the nozzles being indicated). Molybdenum face plate 12 is held between copper conductor clamps 42, attached to high-current leads (not shown). Liquid metal sprays through each orifice 14 having a diameter of 100 micrometers formed in the tip of each protrustion 16 having a height of 4 mm. Molybdenum face plate 12 is narrowed at points 44 to reduce heat losses through clamps 42. Reservoir 47 is suitably formed by a recess formed in face plate 12. In operation, the tips of the nozzles 3 were spaced about 0.2 mm away from apertures 45 of the extractor electrode 18 which was attached rigidly to clamps 42 by alumina insulators 22. Since the assembly was to be used for coating, substrate 24 was positioned opposite extractor electrode 18 as illustrated.

In operation, the nozzles were charged with gold fed into reservoir 47 in the form of wire of 0.5–1.0 mm diameter. Face plate 12 was then electrically heated using alternating current, increasing the current until the gold in the nozzles just melted (about 300 Amps). The heating current was then kept constant and a positive voltage was applied to the strip whilst both the extractor electrode 18 and substrate 24 were held at earth potential. The voltage difference between the face plate and the extractor electrode was gradually increased, until some of the nozzles produced gold sprays.

Figure 9:
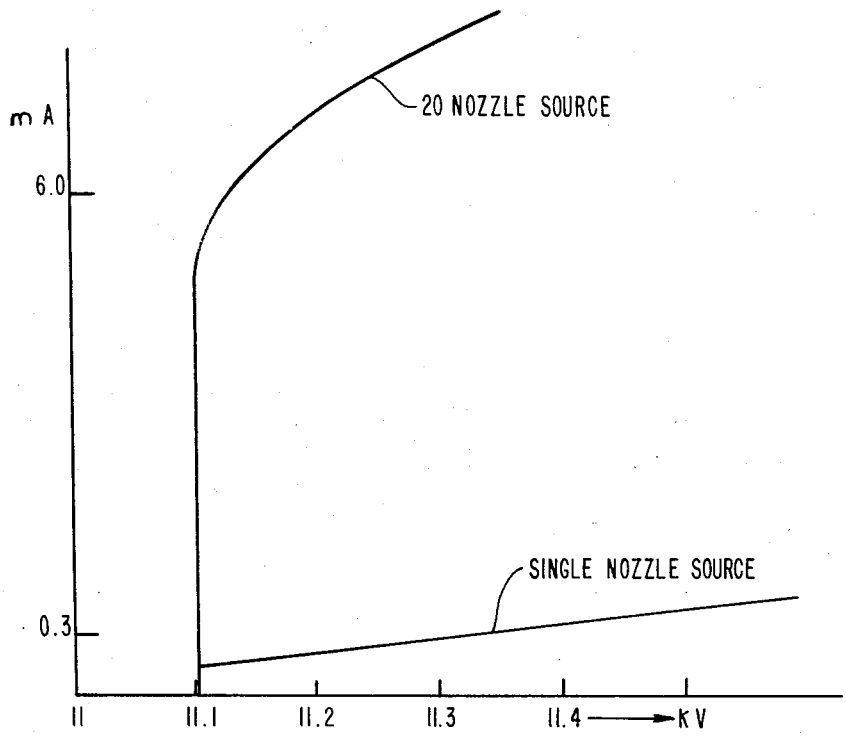
FIG. 9 illustrates the relationship between the spray current and the voltages on the nozzle strip for a single nozzle source and a twenty nozzle source.

Spraying started at about 11.1 kV. A further increase in voltage on the strip to 11.2 kV caused all the nozzles to spray. As the spray was almost fully charged, it generated an electrical current in the substrate 24 placed beyond the extractor electrode array, the value of this current being proportional to the intensity of the spray or the flow of the metal through the nozzles. The spray current and the positive voltage on the nozzle strip were plotted on a chart recorder and a relationship between the two was established. It was found that when the voltage was further increased, the spray current increased proportionally until a limiting current of about 12 milli-amps was reached when arcing occurred between the nozzle tips and the extractor electrode. The throughput of the source was proportional to the number of nozzles, and FIG. 9 illustrates the relationship between the spray currents and the voltages on the nozzle strip for a single-nozzle source and the twenty-nozzle one. At 11.2 kV, the throughput of material from a single-nozzle source was about 1.5 mg/min while for a twenty-nozzle source, it was approaching 30 mg/min.

EXAMPLE 3

In this example, the spraying of silver was achieved with a three-nozzle source fabricated from a tantalum strip. In all other respects, the source was operated in the manner illustrated in example 2. Spraying of all three nozzles was achieved when the voltage on the extractor electrode reached 10.6 kV. When the voltage reached 11.0 kV, the current measured between the nozzle strip and a substrate was 0.75 mA.

EXAMPLE 4

In this example, the spraying of an alloy containing 37.6 wt % gold, 11.5 wt % silver and 50.9 wt % copper was achieved with a two-nozzle source fabricated from a molybdenum strip. In all other respects, the source was operated in the manner illustrated in example 2. Spraying of both nozzles was achieved when the voltage on the strip current measured between the nozzle strip and substrate was 0.5 mA. The composition of the deposit on the substrate was essentially the same as that of the alloy wire used as feed material.

EXAMPLE 5

In this example, the deposition of gold is illustrated with reference to FIG. 3, wherein a molybdenum face plate 12 of thickness 0.5 mm is clamped at its ends to copper conductors 42, attached to two high current leads (not shown). The central part of the face plate 12 is recessed to form a reservoir 47, at the base of which are protrusions 16 each having a depth of 4 mm and 100 micron orifice 14. The orifices are spaced 0.2 mm above, and have axes collinear with, cylindrical apertures 45 in an extractor electrode 18, fabricated by pressing out the cylinders from copper sheet 19. The internal diameter of the cylinders is about 2.5 mm, their wall thickness about 0.2 mm, their length about 4 mm and, like the nozzles, their centres are seperated by a distance of 3.5 mm. The extractor electrode assembly 18 is bolted to the face plate 12 by alumina insulators 22 and below it substrate 24 may be placed.

In operation, the nozzles were charged with a small quantity of gold, fed in the form of a wire of 0.5–1.0 mm diameter. The strip 12 was then electrically heated using AC (about 300 Amps) until the gold in the nozzles just melted. The heating current was then kept constant and a positive bias voltage applied to the strip whilst both the extractor array 18 and the substrate 24 were held at earth potential; the bias voltage was gradually increased until spraying commenced. This voltage, which was found to be sensitive both to the nozzle tip orifice and its separation from the extractor electrode, was of the order of 11.1 kV. While the temperature of the strip 12 remained at no more than a little above the melting-point of gold (this limitation being necessary to prevent arcing between the nozzles and extractor electrodes), a stable spray was obtained over long periods, yielding deposition rates of the order of 0.5–1.0 microns per minute per nozzle. The coatings were found to be strongly adherent to the copper substrate and to have a very dense microstructure.

EXAMPLE 6

In this example, a two-nozzle source was assembled in which the nozzles were separated by a distance of 10 mm and were situated about 0.1 mm above the plane of a copper sheet containing two circular holes of 2.5 mm diameter having common axes with the corresponding nozzles. 10 mm below the above sheet was situated another copper sheet containing two rectangular slits 20 mm long by 4 mm wide positioned so that the nozzle axes passed through the slits 2 mm from one end (A) and 18 mm from the other end (B). In operation, the copper substrate was moved parallel to the slits in the direction B to A. A double stripe deposit was obtained having high density and good adhesion as a result of the sputter cleaning by the charged atoms in the leading edge of the spray prior to deposition. Those charged atoms in the trailing edge of the spray were masked from the substrate by the lower sheet of the electrode.

We claim:

1. A high-throughput device for field emission spraying of metal or alloys in the liquid state, comprising: a feed electrode nozzle array including a face plate of electrically conductive material insoluble in but wettable by the metal to be sprayed having formed thereupon an array of two or more substantially conical nozzles each having an orifice formed at the tip thereof, reservoir means adjacent said face plate for retaining metal to be sprayed and means for heating said face plate to a temperature in excess of the melting-point of the metal to be sprayed by passing an electric current therethrough.

2. The device according to claim 1 wherein the nozzles in the face plate are formed therein by a punch and die technique.

3. A device according to claim 1 further comprising an array of two or more extractor electrodes having apertures formed therein adjacent each of said nozzles and means for maintaining the voltage between the nozzles and the extractor electrode between 1 and 18 kV, the nozzle orifice diameter being between 5 and 250 micrometers, the nozzle height ranging between 1 and 5 mm and the separation between the nozzle tips and the top surface of the extractor electrode being between 0 and 2 mm.

4. The device of claim 1 further comprising an extractor electrode positioned adjacent to said face plate having apertures formed therein adjacent to each said conical nozzle.

5. The device of claim 1, further comprising;

an extractor electrode having apertures formed therein adjacent each of said nozzles, each said aperture being bounded by electrically conductive material and encompassing the axis of its associated nozzle, said electrode being configured and disposed relative to said face plate such that extractor electrode material contiguous to each said aperture serves as means for intercepting charged atoms emitted by its associated nozzle while allowing charged droplets to pass through said aperture; and means for imposing an electrical potential on the electrically conductive material bounding each said aperture.

6. The device according to claim 5 wherein said apertures through said electrically conductive material are substantially circular.

7. The device according to claim 6 wherein the extractor electrode further comprises a rigid frame and wherein the electrically conductive material bounding each aperture is a hollow cylinder mounted upon said rigid frame.

8. The device according to claim 5 wherein the extractor electrode is a sheet of electrically conductive material having cylindrical apertures therethrough.

9. The device according to claim 5 wherein said extractor electrode comprises a non-conductive planar spacer and two parallel planar sheets of electrically conductive material rigidly fastened to either side of said spacer, said apertures being formed within said parallel sheets.

10. The device according to claim 5 wherein the distance between the portion of electrically conductive material in the extractor electrode encompassing each said aperture nearest the nozzle associated with said aperture and the portion of electrically conductive material encompassing said aperture furthest from the nozzle associated with said aperture is not substantially less than the radius of the aperture nearest to the nozzle.

11. The device according to claim 5 wherein the extractor electrode is fabricated of the metal or alloy to be used as feed.

12. The device according to claim 5 wherein the extractor electrode is fabricated of a metal or alloy comprising one or more of the constituents of the metal or alloy to be used as feed.

13. The device according to claim 5 wherein the extractor electrode is fabricated of a material resistant to sputtering.

14. The device according to claim 13 wherein the extractor electrode is fabricated of molybdenum.

15. A method of field emissions spraying of metals comprising the steps of:

providing a face plate of electrically conductive material insoluble in but wettable by the metal to be sprayed having formed thereupon an array of two or more substantially conical nozzles each having an orifice formed at the tip thereof;

providing an electrically conductive extractor electrode adjacent to said face plate;

engaging a supply of metal to be sprayed with the side of said face plate opposite said extractor electrode;

heating said face plate to a temperature which is in excess of the melting point of the metal to be sprayed by passing an electric current through said face plate; and urging said metal spray out of said orifices by imposing a potential difference between said face plate and said adjacent electrically conductive extractor electrode.

16. The method of claim 15 wherein said potential difference is sufficient to initiate spraying of ions of said metal to be sprayed.

17. The method of claim 15 wherein said potential difference is sufficient to initiate spraying of droplets of said metal to be sprayed.

18. The method of claim 17 comprising the further step of intercepting sprayed ions of said metal with said extractor electrode while allowing droplets of said metal to pass through said extractor electrode.

19. The process of claim 15 wherein said electrically conductive extractor electrode has apertures formed therein adjacent each of said orifices in said face plate.

20. The process of claim 15 wherein said extractor electrode has apertures formed therein adjacent each of said nozzles, each said aperture being bounded by an electrically conductive material and encompassing the axis of its associated nozzle, said electrode being configured and disposed relative to said face plate such that extractor electrode material contiguous to each said aperture serves as means for intercepting ions emitted by its associated nozzle while allowing charged droplets to pass through said aperture.

21. The process of claim 15 wherein said electrically conductive extractor electrode is a substrate to be coated.

* * * * *